US006722760B2

(12) United States Patent
Jeong et al.

(10) Patent No.: US 6,722,760 B2
(45) Date of Patent: Apr. 20, 2004

(54) INK PRINTING CLICHÉ AND FABRICATION METHOD THEREOF

(75) Inventors: Young-Sik Jeong, Seoul (KR); Myoung-Kee Baek, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/263,202

(22) Filed: Oct. 3, 2002

(65) Prior Publication Data

US 2003/0122896 A1 Jul. 3, 2003

(30) Foreign Application Priority Data

Dec. 29, 2001 (KR) ..... 2001-88553

(51) Int. Cl.[7] ..... B41J 2/35
(52) U.S. Cl. ..... 347/46
(58) Field of Search ..... 347/46, 44, 40, 347/20, 9, 5, 84, 85, 86; 101/41, 150, 93

(56) References Cited

U.S. PATENT DOCUMENTS

2003/0084796 A1 * 5/2003 Kwon et al.

* cited by examiner

*Primary Examiner*—Raquel Yvette Gordon
(74) *Attorney, Agent, or Firm*—Birch, Stewart, Kolasch & Birch, LLP

(57) ABSTRACT

A cliché of a gravure offset printing device is fabricated such that an organic layer and a photoresist layer are formed on a substrate. The photoresist layer is developed to form a photoresist pattern, and in a state that the organic layer is blocked with the photoresist pattern, the organic layer is etched to form a groove. The organic layer allows a fine process, so that a gravure offset printing device adopting the cliché can form a fine ink pattern. This fine pattern produces a resolution that is applicable to the production of semiconductors and liquid crystal display devices.

15 Claims, 5 Drawing Sheets

INK PRINTING CLICHÉ AND FABRICATION METHOD THEREOF

This nonprovisional application claims priority under 35 U.S.C. §119(a) on Patent Application No. 88553/2001 filed in Korea on Dec. 29, 2001, which is herein incorporated by reference.

BACKGROUND OF THE INVENTION

1. Field of the Invention

The invention relates to an ink printing device for pattern formation, and more particularly, to an ink printing cliché capable of forming a fine pattern and lengthening the life span of a printing device by forming a cliché with an organic material or an organic/metal.

2. Description of the Related Art

Display devices, especially a flat panel display such as a liquid crystal display (LCD) device, include an active device such as a thin film transistor (TFT) in each pixel to drive the display device. This display device driving method is called an active matrix driving method. In an active matrix method, the active driving device is disposed in each pixel. The pixels are arranged in a matrix. FIG. 1 illustrates an active matrix liquid crystal display device, in which the liquid crystal display device is a TFT LCD using a thin film transistor as the active device.

As shown in FIG. 1, the TFT LCD has N×M pixels vertically and horizontally arranged. Each pixel has a gate line 4 to which a scan signal is applied from an external driving circuit, a data line 6 to which an image signal is applied, and a TFT formed at the intersection of the gate line 4 and the data line 6.

The TFT includes a gate electrode 3 connected to the gate line 4. A semiconductor layer 8 is formed on the gate electrode 3, and the semiconductor layer 8 activates when a scan signal is applied to the gate electrode 3. A source/drain electrode 5 is formed on the semiconductor layer 8.

A pixel electrode 10 is formed at a display region of the pixel 1, and the pixel electrode 10 connects to the source/drain electrode 5. An image signal is applied through the source/drain electrode 5 as the semiconductor layer 8 is activated, to thereby activate a liquid crystal (not shown).

The source/drain electrode 5 of the TFT is electrically connected to the pixel electrode 10 formed in the pixel 1, so that as a signal is applied to the pixel electrode 10 through the source/drain electrode 5, the source/drain electrode 5 drives the liquid crystal and displays an image.

In the active matrix type display device such as the liquid crystal display device, each pixel has a size of scores of $\mu$m. Thus, the active device such as the TFT disposed in the pixel should have a fine size, i.e., a few $\mu$m.

In addition, high picture quality display devices such as the high definition (HD) TV have been in increasing demand. These devices require a greater concentration of pixels occupying a screen of the same area. As a result, the active device pattern (including gate line and data line patterns) disposed on the pixel also becomes more dense and requires a finer structure.

In the conventional art, fabrication of an active device, such as a TFT, utilizes a pattern or a line of the active device formed by a photolithography method using an exposure device.

However, this photolithography method uses a high-priced exposing device. The steps of photolithography can include vapor prime, spin coat, soft bake, alignment and exposure through a mask, post-exposure bake, development, hard bake and inspection. The result is increased fabrication cost and a complicated fabrication process.

Additionally, the exposure region of the exposing device is limited in the photolithographic production of a display device. In order to fabricate a large-scale display device, the screen is divided to accommodate the photolithographic process. This degrades productivity because it is difficult to accurately match the positions when processing the divided regions, and the photolithographic process has to be repeated several times.

In order to solve this problem, pattern forming by gravure offset printing has been recently proposed.

Gravure offset printing is a printing method in which ink is put on a concave plate. Redundant ink is removed by scraping or doctoring, and then printing is performed. This printing method has been adopted in various applications such as printing wrappings of cellophane, vinyl or polyethylene.

Recently, efforts have been made to adapt gravure printing to produce an active device used for the display device or to produce a circuit pattern.

Gravure offset printing transfers ink to a substrate by using a transfer roll, and a pattern can be formed by a single printing step. Even a large-scale display device can be produced by using a transfer roll corresponding to the area of the desired display device.

Gravure offset printing can be used to pattern various configurations and sub-assemblies of the display device. These can include, for example, a metal pattern for a capacitor, a pixel electrode, the gate line and the data line connected to the TFT, and the TFT, which are all structures necessary for a liquid crystal display device.

FIGS. 2A through 2C illustrate pattern forming by a conventional gravure offset printing method.

As shown in FIG. 2A, the conventional gravure offset printing method forms a groove 22 at a specific position of a cliché 20 or a concave plate. The groove 22 corresponds to a pattern that is desired to form on a substrate. The groove 22 is filled with ink 24.

The ink 24 in the groove 22 results in pattern forming ink 24 being coated at an upper portion of the cliché 20, and then a doctor blade 28 proceeds while in contact with the cliché 20. A doctor blade 28 proceeds to impress the ink 24 filled into the groove 22. The doctor blade simultaneously removes the excess ink 24 remaining on the surface of the cliché 20. Alternatively, a Meyer rod can be used instead of a doctor blade.

As shown in FIG. 2B, the ink 24 filling in the groove 22 of the cliché 20 contacts and transfers to the surface of the transfer role 30.

The transfer roll 30 is formed with a circumference having the same length as that of the panel of a display device to be fabricated. That is, the transfer roll 30 has the circumferential length equal to the length of the desired panel. Accordingly, the ink 24 filled in the groove 22 of the cliché 20 can be wholly transferred on the surface of the circumference of the transfer roll 30 by a single rotation.

Thereafter, as shown in FIG. 2C, the transfer roll 30 contacts the surface of a process-object layer 41 formed on the substrate 40, and the transfer roll 30 is rotated. Then, the ink 24 transferred on the transfer roll 30 is re-transferred on the process-object layer 41. By applying heat to the re-transferred ink 24 and drying it, an ink pattern 42 is formed. At this time, the desired ink pattern 42 can be formed on the entire substrate 40 of the display device by a single rotation of the transfer roll 30.

In the gravure offset printing method discussed above, since the ink pattern 42 is mechanically formed by using the cliché 20, and the transfer roll 30 and the process-object layer 41 is etched by the ink pattern 42 to form a desired pattern, the pattern forming process is simplified compared to the conventional photolithographic exposure process.

However, the conventional art gravure offset method has shortcomings. Generally, since the cliché 20 is made of a metal such as ferrite and nickel, it is difficult to form a fine groove.

Usually, the groove 22 of the cliché 20 is formed by a mechanical process. In this respect, it is not substantially possible to mechanically process a groove of below a few μm. Thus, it is difficult to form a fine ink pattern, and this process can scarcely be adopted to fabricate a display device.

In addition, the surface of the metal cliché 20 becomes damaged due to abrasion by the doctor blade 28, and particles are generated. These particles are a critical factor leading to pattern defects during formation of an ink pattern. Moreover, since the grain is large, a rough edge region of the groove is formed when the groove is processed, which makes it impossible to form a smooth ink pattern.

As has been shown, the conventional art gravure process using a cliché has serious drawbacks that hamper adaptation of this technology to the production of semiconductor devices such as liquid crystal displays.

SUMMARY OF THE INVENTION

The invention, in part, provides a cliché of a gravure offset printing device and its fabrication method that are capable of forming a fine ink pattern and a final fine pattern by forming the cliché with an organic material.

The invention, in part, provides a cliché of a gravure offset printing device and its fabrication method that are capable of forming a fine pattern having a lengthened life span by forming a cliché with an organic material/metal.

To achieve these and other advantages and in accordance with the invention, there is provided a gravure offset printing device including a cliché with a groove formed in which ink is filled and a transfer roll for re-transferring the ink transferred from the cliché to a process-object layer, wherein the cliché includes a substrate and an organic layer with a groove formed in a portion of the organic layer.

In the gravure offset printing device of the invention, the substrate is made of glass, plastic or semiconductor wafer, and the organic layer is made of a polymer, polyimide, photosensitive acrylate or methacrylate, or BCB (Benzocyclobutene). The organic layer is grain-free.

In the invention, a metal layer may be formed over the organic layer to lengthen the life span of the cliché, and an intermediate layer can be formed to improve the adhesion force between the organic layer and the metal layer.

The invention, in part, pertains to a cliché fabrication method including the steps of preparing a substrate, depositing an organic layer and a photoresist layer over the substrate, developing the photoresist layer to form a photoresist pattern, and etching the organic layer while the organic layer is blocked with the photoresist pattern, to form a groove.

The foregoing and other objects, features, aspects and advantages of the invention will become more apparent from the following detailed description of the invention when taken in conjunction with the accompanying drawings, which provide further explanation of the invention, as claimed.

BRIEF DESCRIPTION OF THE DRAWINGS

The accompanying drawings are included to provide a further understanding of the invention. The drawings illustrate embodiments of the invention and together with the description serve to explain the principles of the embodiments of the invention.

DETAILED DESCRIPTION

Advantages of the present invention will become more apparent from the detailed description given herein after. However, it should be understood that the detailed description and specific examples, while indicating preferred embodiments of the invention, are given by way of illustration only, since various changes and modifications within the spirit and scope of the invention will become apparent to those skilled in the art from this detailed description.

Reference will now be made in detail to the preferred embodiments of the invention, examples of which are illustrated in the accompanying drawings.

The invention provides a gravure offset printing device which is capable of forming a fine pattern. In order to use a gravure offset printing device to produce a fine pattern, a cliché is made of an organic material.

Generally, the organic material allows fine process detail by dry etching. If the cliché is made of the organic material, a fine groove can be formed.

In addition, since the organic material has no grain or a small grain, an edge region is smoothly formed when forming a groove.

Various types of organic materials can be used, preferably polymers, polyimide, BCB (benzocyclobutene) or a photosensitive acrylate or methacrylate. The cliché is formed by coating the organic material on a substrate. The substrate can be a glass substrate, a plastic substrate or a semiconductor wafer that can be an Si or GaAs wafer.

The cliché of the invention can be constructed as a double layer having an organic layer and a metal layer. The cliché with a double layer structure is advantageous in that it has a long life span due to the characteristics of the metal layer, and an ink pattern can be smoothly formed thanks to the grain-free organic layer.

A preferred embodiment of the invention will now be described in detail with reference to the accompanying drawings.

FIGS. 3A through 3D show a sequential process of a method for fabricating a cliché in accordance with one embodiment of the invention.

Figure 1:
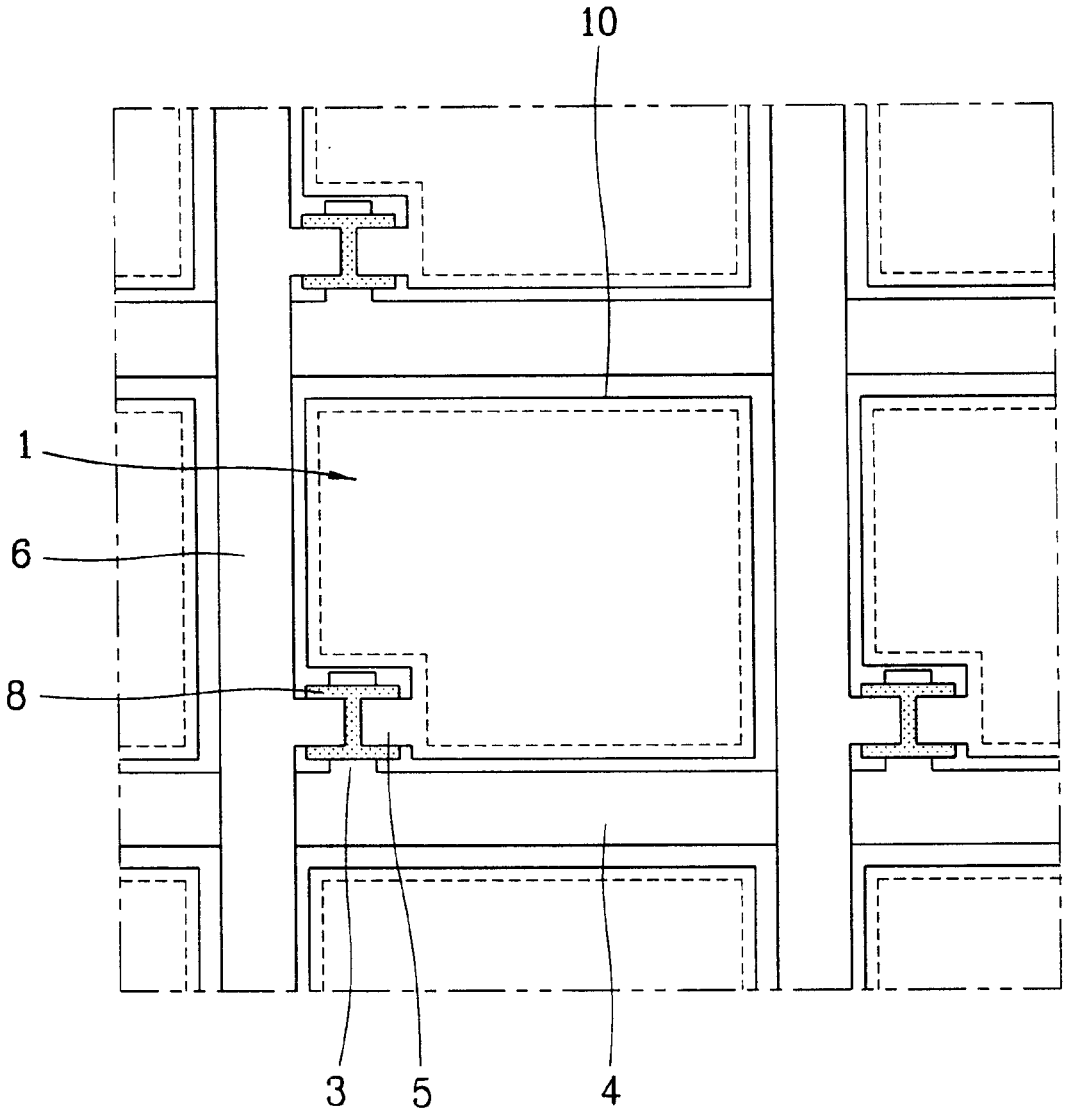
FIG. 1 CONVENTIONAL ART
FIG. 1 is a plan view showing the structure of a general liquid crystal display device.
Figure 2A:
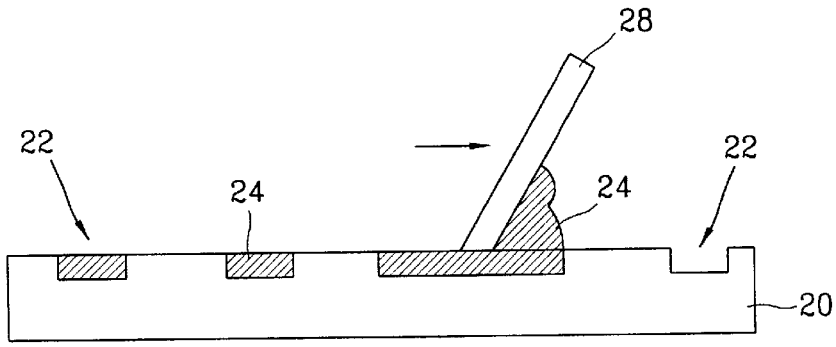
FIG. 2A CONVENTIONAL ART
FIGS. 2A through 2C show a sequential process of a method for forming a pattern such as a display device by using a conventional art gravure offset printing method.
Figure 2B:
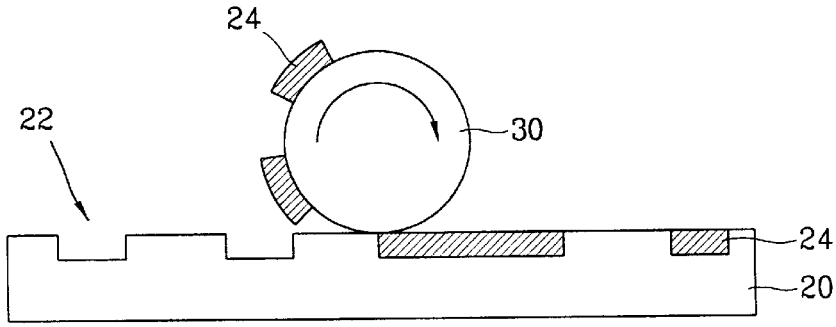
FIG. 2B CONVENTIONAL ART
Figure 2C:
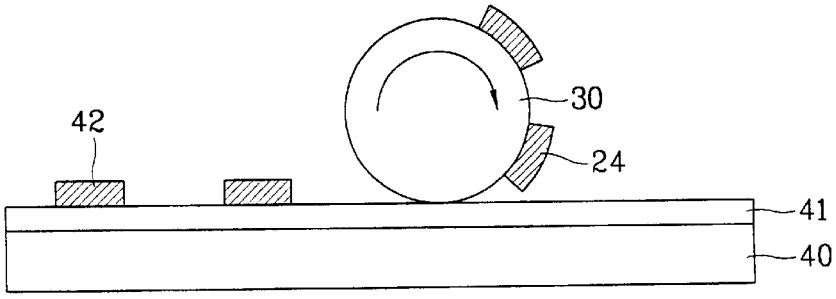
FIG. 2C CONVENTIONAL ART
Figure 3A:
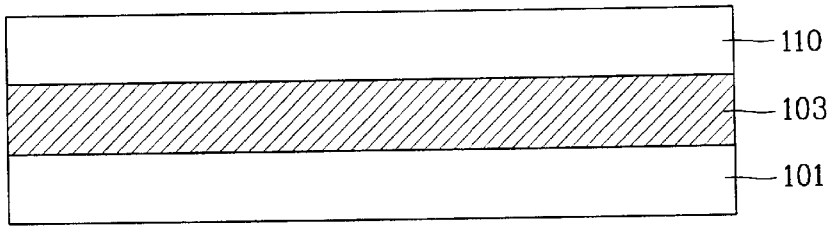
FIGS. 3A through 3D show a sequential process of a method for fabricating a cliché in accordance with an embodiment of the present invention.

First, as shown in FIG. 3A, an organic material such as polymer, polyimide, BCB or photosensitive acrylate or methacrylate is deposited on a substrate 101 made of a material such as glass, plastic or a wafer to from an organic layer 103. Over the organic layer 103, a photoresist layer 110 made of photosensitive resin is formed.

Figure 3B:
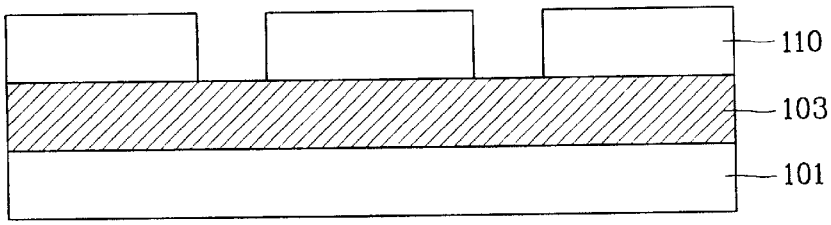

Thereafter, a mask with an opening is positioned at region corresponding to a pattern desired to form on the photoresist layer 110. Light such as an ultraviolet ray is irradiated, and a developer patterns the photoresist layer 110, as is shown in FIG. 3B.

Figure 3C:
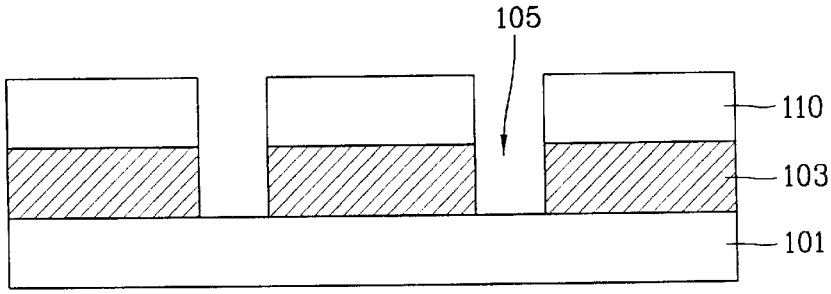
Figure 3D:
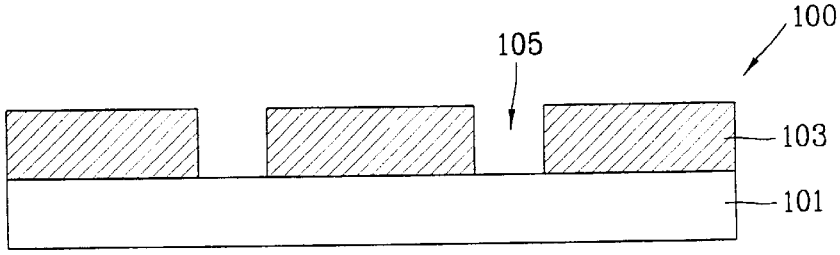

At this point, the organic layer 103 is blocked by the patterned photoresist layer 110. Then, the organic layer 103 is etched to form a groove 105, as shown in FIG. 3C. The photoresist layer 110 on the organic layer 103 is then removed to complete a cliché 100 with a groove 105, as shown in FIG. 3D.

Ink is filled in the groove 105 of the cliché 100, and the ink is transferred onto a process-object layer of the substrate by using a transfer roll. Then, an etching process is performed to thereby obtain the desired pattern (corresponding to the groove of the cliché).

As stated above, the cliché 100 in accordance with one embodiment of the present invention has a substrate 101 and an organic layer 103, and the ink-filling groove 105 is formed in the cliché 100.

Usually, it is difficult to form a fine pattern with a gravure offset printing device (for example, a metal pattern such as an electrode), compared to a pattern formed by a general exposure process. However, in the above-described embodiment of the invention, if the cliché 100 is formed on the substrate 101 and the organic layer 103 and the groove 105 is formed by the exposure process, a fine pattern can be formed with the same or better resolution compared to the resolution formed by the conventional exposure process.

By adopting the thus fabricated cliché, the gravure offset printing device can form a fine pattern with a very simple process compared to the conventional pattern forming method. That is, a fine pattern forms with simple processing by adopting the cliché of the present invention to the gravure offset printing device.

In the invention, the avoidance of grain formation is important. In a singlet molecule such as a metal, the probability of aggregation is very high, and grains are easily generated. On the other hand, organic materials have a very low probability of grain formation because of the interactions between the organic chains. Thus, a grain structure cannot be generated in an organic material (or layer), and the roughness of the organic layer is reduced. As a result, a cliché having fine patterns can be fabricated.

In addition, since the organic layer 103 is grain-free (or at least has very small grains), a smooth ink pattern is formed. Thus, a precise pattern can be formed. When fabricating a display device such as a liquid crystal display by the gravure printing device adopting the inventive cliché, a high resolution display device can be obtained.

FIGS. 4A through 4D show a sequential process for fabricating a cliché in accordance with another embodiment of the present invention.

Figure 4A:
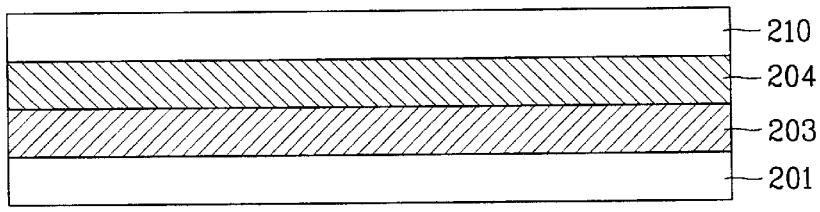
FIGS. 4A through 4D show a sequential process of a method for fabricating a cliché in accordance with another embodiment of the present invention.

First, as shown in FIG. 4A, an organic material such as polymer, polyimide, BCB or photosensitive acrylate or methacrylate is deposited on a substrate 201 to form an organic layer 203, over which a metal layer 204 is formed. The metal layer 204 can be made of AlNd, Cr, Mo, Cu, W, Si and alloys of these metals. Preferably, AlNd or Cr is used. A photoresist layer 210 is formed over the metal layer 204.

At this time, though not shown in the drawing, an intermediate layer may be formed between the organic layer 203 and the metal layer 204 in order to improve the cementing force between the organic material and the metal.

Figure 4B:
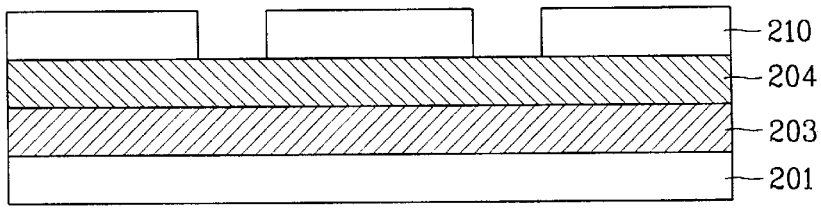

Subsequently, a mask is positioned over the photoresist layer 210, which is irradiated by light such as a ultraviolet ray, and a developer is applied to thereby pattern a photoresist layer 210, as shown in FIG. 4B.

Figure 4C:
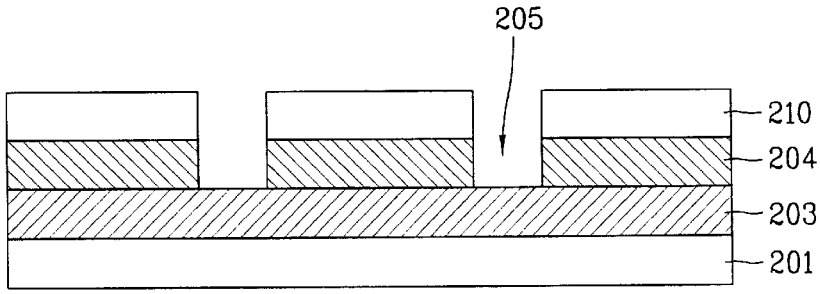

A portion of the metal layer 204 is blocked with the patterned photoresist layer 210, and a metal layer 204 is etched by an etching process to expose a portion of the organic layer 203. As shown in FIG. 4C, the exposed organic layer 203 is etched by an etching process to form a groove 205.

Figure 4D:
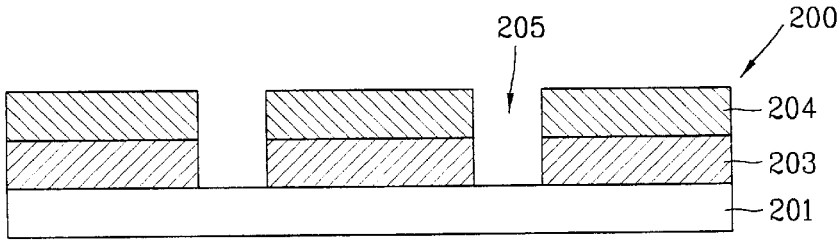

Thereafter, as shown in FIG. 4D, the photoresist layer 210 on the metal layer 204 is removed to complete a cliché 200 with a groove 205 formed therein.

For the etching of the metal layer 204 and the organic layer 203, a general wet etching or a dry etching process can used. Wet etch solutions include acids, bases and organic solvents. Dry etching can include plasma etch or reactive ion etch (RIE).

When forming the cliché 200 with the substrate 201, the organic layer 203 and the metal layer 204, a life span lengthening effect can be also obtained due to the metal layer 204. In addition, a fine ink pattern can be formed and a smooth ink pattern can be formed due to the properties of the organic layer 203.

Figure 5:
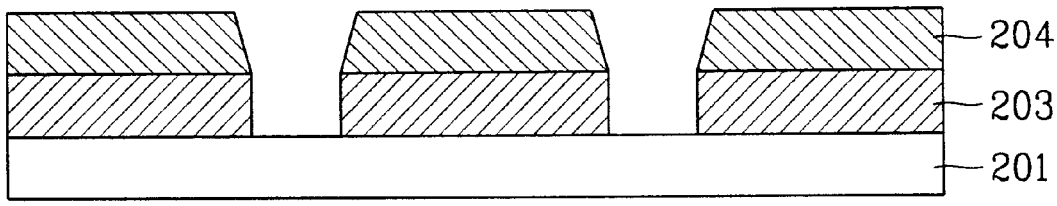
FIG. 5 is a sectional view showing the structure of a cliché with a tapered metal layer.

As shown in FIG. 4D, the metal layer 204 can be almost vertically etched, but as shown in FIG. 5, the metal layer 204 may be etched to be tapered by controlling the etching speed of the etchant used for etching.

If a pattern is formed by using the gravure offset printing device with the tapered cliché, a tapered pattern can be obtained, so that a problems due to pattern stepping can be avoided.

As mentioned above, in the invention, a cliché is fabricating by having a substrate and an organic layer, or a substrate and organic layer/metal layer is used. The organic layer or the organic layer/metal layer is processed to form the groove for filling ink therein. The cliché with such a structure is thus adapted to use a gravure offset printing device form a pattern.

In gravure offset printing, a fine ink pattern can be formed with the cliché having the above-described structure. Thus, when the cliché is used in conjunction with the gravure offset printing device, a gravure offset printing method can be used to produce various devices requiring a fine pattern. These devices include semiconductors as well as display devices such as liquid crystal displays. Other displays such as electrochemochromic displays can be also produced by the invention.

As described above, the inventive cliché of the gravure offset printing device used to form a pattern is made of an organic material, allowing fine processing to produce a fine ink pattern. This results in a device having high resolution.

In addition, by fabricating the cliché by forming a double layer of the organic material and the metal, a fine pattern can be formed while attaining a lengthened, semi-permanent life span.

It is to be understood that the foregoing descriptions and specific embodiments shown herein are merely illustrative of the best mode of the invention and the principles thereof, and that modifications and additions may be easily made by those skilled in the art without departing for the spirit and scope of the invention, which is therefore understood to be limited only by the scope of the appended claims.

What is claimed is:

1. A gravure offset printing device, which comprises:

a cliché, the cliché having a substrate and an etching object layer over the substrate, the etching object layer including an organic layer;

a groove formed in the cliché in which ink is filled, the groove being formed in a portion of the organic layer; and a transfer roll for transferring the ink from the cliché to a process-object layer.

2. The device of claim 1, further comprising a metal layer formed on the etching object layer, the metal layer a second groove aligned with the groove of the organic layer.

3. The device of claim 2, further comprising an intermediate layer between the etching object layer and the metal layer, wherein the intermediate layer improves a cementing force between the etching object layer and the metal layer.

4. The device of claim 2, wherein the metal layer is tapered.

5. The device of claim 1, wherein the substrate is made of material selected from a group consisting of glass, plastic and a semiconductor wafer.

6. The device of claim 1, wherein the etching object layer is an organic layer made of a material selected from the group consisting of polyimide, photosensitive acrylate, photosensitive methacrylate and BCB (benzocyclobutene).

7. The device of claim 1, wherein the etching object layer is grain-free.

8. A cliché fabrication method, which comprises:

preparing a substrate;

forming an etching-object layer and a photoresist layer over the substrate;

developing the photoresist layer to form a photoresist pattern; and etching the etching-object layer to form a groove.

9. The method of claim 8, wherein the etching-object layer comprises an organic layer.

10. The method of claim 9, wherein the organic layer comprises a material selected from a group consisting of polyimide, photosensitive acrylate, photosensitive methacrylate and BCB (benzocyclobutene).

11. The method according to claim 9, wherein the organic layer is grain-free.

12. The method of claim 8, wherein the etching-object layer comprises:

an organic layer; and a metal layer over the organic layer.

13. The method of claim 12, wherein the organic layer comprises a material selected from a group consisting of polyimide, photosensitive acrylate, photosensitive methacrylate and BCB (benzocyclobutene).

14. The method of claim 12, further comprising:

forming an intermediate layer over the organic layer to improve a cementing force between the organic layer and the metal layer.

15. The method according to claim 12, wherein the organic layer is grain-free.

* * * * *